US007066213B2

(12) United States Patent
Schaich

(10) Patent No.: US 7,066,213 B2
(45) Date of Patent: Jun. 27, 2006

(54) CATCHING AND HOLDING APPARATUS FOR THE CATCHING-SIDE WEFT THREAD END IN A WEAVING MACHINE

(75) Inventor: Urs Schaich, Eschenbach (CH)

(73) Assignees: Sultex AG, Reuti (CH); Joweid Zentrum, Reuti (CH)

( * ) Notice: Subject to any disclaimer, the term of this patent is extended or adjusted under 35 U.S.C. 154(b) by 0 days.

(21) Appl. No.: 10/421,001

(22) Filed: Apr. 22, 2003

(65) Prior Publication Data

US 2003/0201026 A1 Oct. 30, 2003

(30) Foreign Application Priority Data

Apr. 26, 2002 (EP) ..... 02405344

(51) Int. Cl.
*D03D 47/30* (2006.01)

(52) U.S. Cl. ..... 139/435.5

(58) Field of Classification Search ..... 139/194, 139/434, 435.5, 116.1, 195; 226/97.1; 57/263
See application file for complete search history.

(56) References Cited

U.S. PATENT DOCUMENTS 4,465,110 A * 8/1984 Dekker ..... 139/370.2
4,984,608 A * 1/1991 Bertsch et al. ..... 139/434
5,224,521 A * 7/1993 De Jager ..... 139/194
5,316,050 A 5/1994 Bertsch
5,735,316 A * 4/1998 Hehle ..... 139/194
6,014,990 A * 1/2000 Bamelis et al. ..... 139/194
6,076,563 A * 6/2000 Wahhoud et al. ..... 139/194
6,082,413 A * 7/2000 Scorl et al. ..... 139/194
6,220,308 B1 * 4/2001 Speich ..... 139/194
6,536,482 B1 * 3/2003 Peeters et al. ..... 139/435.5

FOREIGN PATENT DOCUMENTS

EP 1 083 253 A1 3/2001

* cited by examiner

*Primary Examiner*—John J. Calvert
*Assistant Examiner*—Andrew W. Sutton
(74) *Attorney, Agent, or Firm*—Townsend and Townsend and Crew

(57) ABSTRACT

A catching and holding apparatus for catching-side weft thread ends in a weaving machine comprises a main nozzle and a catching passage for holding and stretching a weft thread end and a carrier on which the main nozzle and the catching passage are arranged. Furthermore, the catching and holding apparatus also comprises an auxiliary nozzle and one or more guides, which are arranged on the carrier in such a manner that a weft thread end which is located in the active region of the auxiliary nozzle is brought by an air jet of the auxiliary nozzle along the guides into the active region of the main nozzle.

9 Claims, 7 Drawing Sheets

CATCHING AND HOLDING APPARATUS FOR THE CATCHING-SIDE WEFT THREAD END IN A WEAVING MACHINE

BACKGROUND OF THE INVENTION

The invention relates to a catching and holding apparatus for the catching-side weft thread end and to a weaving machine comprising a catching and holding apparatus of this kind. Furthermore, the invention relates to a method for the holding and the stretching of the weft thread end and for the transporting away of the severed weft thread end.

In weaving machines, in particular air jet weaving machines, the catching-side ends of inserted weft threads are stretched and held by means of a catching and holding nozzle until the weft thread is beat up and/or the ends are severed. Conventional catching and holding nozzles are therefore frequently also designated as stretching nozzles. In a nozzle of this kind the weft thread ends are engaged by a nozzle jet and led into an opening of a catching tube or passage and held there through the air flow of the nozzle jet.

In the specification of U.S. Pat. No. 4,465,110 a stretching nozzle is described which is arranged at the catching-side end of a reed of an air jet weaving machine. The stretching nozzle comprises a carrier with a cut-out which forms an extension of the guiding passage in which the weft thread is guided during the insertion, as well as a nozzle and a catching passage, which are arranged perpendicularly to the weft insertion direction and which open into the cut-out at opposite sides. The cross-section of this guide passage necessarily has a certain size, through which a relatively large distance between the outlet opening of the nozzle and the catching opening of the catching passage results. In order to bring the weft thread end reliably into the catching opening, a relatively large pressure is required, which leads to a correspondingly large air consumption.

In general a certain distance must be present in a conventional catching and holding nozzle between the outlet opening of the nozzle and the catching opening of the catching passage due to the spatial and possibly also temporal scattering of the thread position. The greater the distance, the more reliably can the thread be engaged by the nozzle jet. Limits are reached, however, in the enlarging of the distance. A free nozzle jet propagates in the form of a cone with an opening angle of approximately 24°, which means that the greater the distance between the outlet opening of the nozzle and the catching opening of the catching passage is, the larger the catching opening must be. A larger cross-section means however a lower air velocity and consequently a lower force acting on the thread. In order to achieve a sufficiently large force acting on the thread, the entry pressure must be increased correspondingly, which necessarily leads to an increased air consumption. Once the speed of sound is reached, the acting force can no longer be increased.

SUMMARY OF THE INVENTION

An object of the invention is to make available a catching and holding apparatus for the catching-side weft thread end which reliably captures the weft thread end and holds it firmly in the catching passage with as great a force as possible, and which can be operated with an air consumption which is reduced in comparison with the prior art. A further object of the invention is to make a method available by means of which the catching-side weft thread ends are reliably captured and held firmly in the catching passage with as great a force as possible, and which manages with an air consumption which is reduced in comparison with the prior art.

The catching and holding apparatus in accordance with the invention for catching-side weft thread ends in a weaving machine comprises a main nozzle with a local active region and a catching passage with a catching opening which lies in the active region of the main nozzle as well as a carrier on which the main nozzle and the catching passage are arranged. Furthermore, the catching and holding apparatus also comprises an auxiliary nozzle with a local active region and one or more guides, which can be executed either on one side or on both sides. The auxiliary nozzle and the guides are arranged on the carrier in such a manner that a weft thread end which is located in the active region of the auxiliary nozzle is brought by an air jet of the auxiliary nozzle along the guides into the active region of the main nozzle.

The catching and holding apparatus is preferably provided on a weaving machine with a sley and reed, with the catching and holding apparatus being arranged in such a manner that the weft thread end can be transported into the active region of the auxiliary nozzle by a beat-up movement of the reed. The carrier preferably comprises a slot or a cut-out, for example a mouth-like cut-out, with the main nozzle comprising a nozzle jet outlet opening which opens into the slot or the cut-out and the associated catching passage comprising a catching opening which opens into the slot or the cut-out. The jet directions of the main and auxiliary nozzles are preferably arranged to be parallel or to have an acute angle with respect to one another, or the main and auxiliary nozzles are arranged in such a manner that the projection of the jet directions onto a plane form an acute angle.

In a preferred embodiment, the main nozzle comprises a nozzle tube, with the forward part of the nozzle tube being usable as a guide along which the weft thread end is transported into the active region of the main nozzle. The nozzle jet outlet opening of the main nozzle is preferably arranged ahead of the catching opening of the catching passage, and the distance between the nozzle jet outlet opening of the main nozzle and the catching opening of the catching passage is preferably not greater than the diameter of the catching passage.

In a further preferred embodiment, the carrier with the main nozzle, the catching passage, the auxiliary nozzle and the guide are arranged on the sley or on the reed, and the catching and holding apparatus additionally comprises a deflector or raking in element which is stationarily mounted on the weaving machine and which is arranged in such a manner that the weft thread end can be transported into the active region of the auxiliary nozzle by means of the deflector element in response to a beat-up movement of the reed.

In the method in accordance with the invention for the catching, stretching and holding of a catching-side weft thread end in a weaving machine, the weaving machine comprising a catching and holding apparatus with a main nozzle and a catching passage as well as a reed, with the catching and holding apparatus additionally comprising an auxiliary nozzle and one or more guides, the weft thread end is transported into the active region of the auxiliary nozzle through a beating up of the reed; the weft thread end is transported by an air jet of the auxiliary nozzle along the guides into the active region of the main nozzle; and the weft thread end is blown by an air jet of the main nozzle into the catching passage, with the weft thread end being stretched and held.

In a preferred embodiment of the method, the weaving machine also comprises a severing apparatus, with the weft thread end being severed by means of the severing apparatus after its capture by the catching and holding apparatus; and the severed weft thread end is transported away through the catching passage by the air jet of the main nozzle.

With the help of the apparatus in accordance with the invention and the method in accordance with the invention, it is possible to reliably capture a weft thread with an air consumption which is reduced in comparison with the prior art. Furthermore, a specific holding and stretching force can be achieved in the apparatus in accordance with the invention with an air consumption which is reduced in comparison with the prior art. In addition it is possible to produce greater holding and stretching forces with the apparatus in accordance with the invention, which is an important advantage in particular in the case of greater weaving widths.

In an advantageous embodiment of the apparatus in accordance with the invention and of the method in accordance with the invention, it is possible to transport the severed weft threads away through the catching passage. A so-called auxiliary selvedge can be dispensed with in this case.

In the following the invention will be explained in more detail with reference to exemplary embodiments and with reference to the drawings.

DESCRIPTION OF THE PREFERRED EMBODIMENTS

Figure 1:
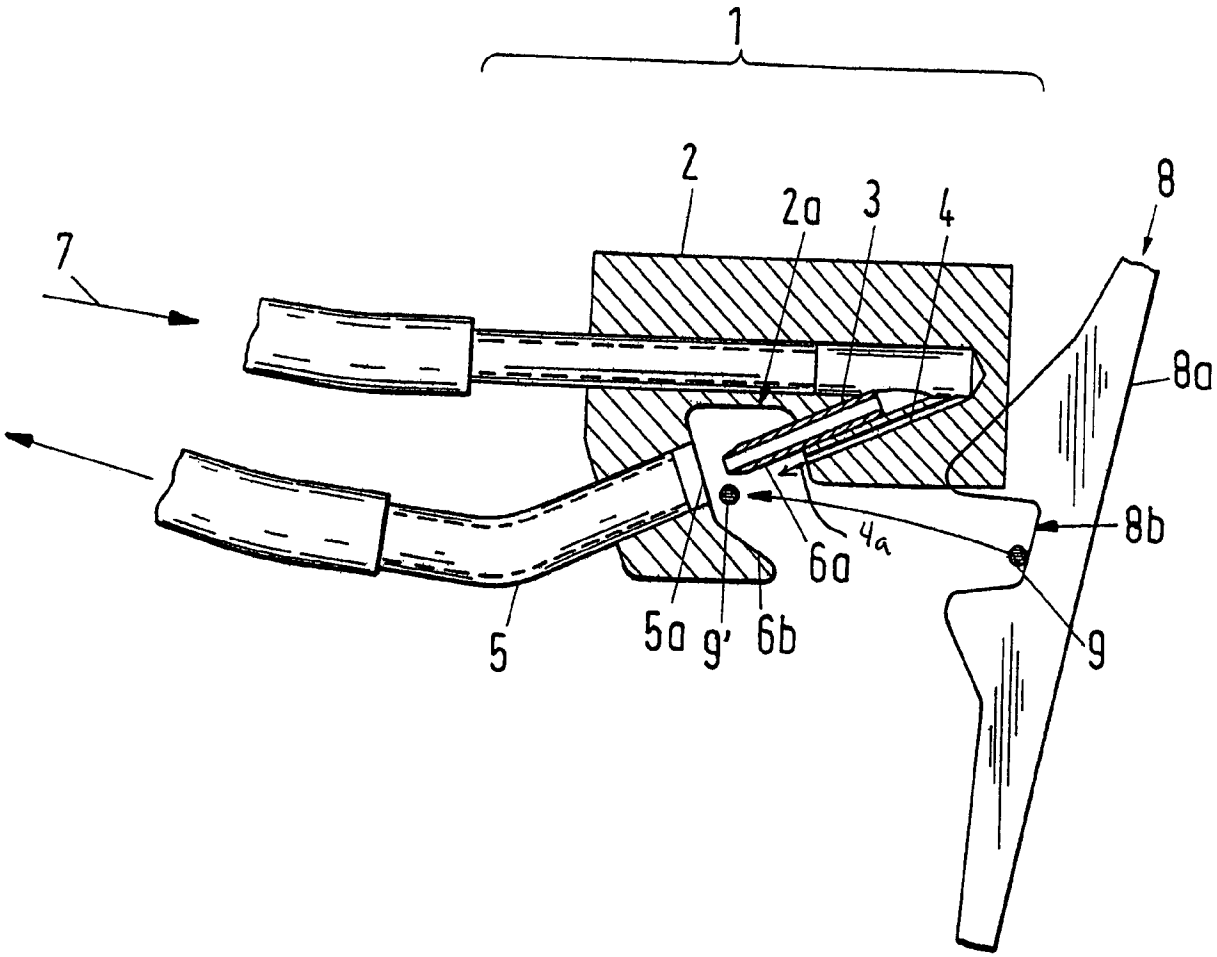
FIG. 1 illustrates a first exemplary embodiment pertaining to the present invention in cross-section.

FIG. 1 shows a first exemplary embodiment pertaining to the present invention in cross-section. The catching and holding apparatus 1 of the first exemplary embodiment comprises a carrier 2 which is provided on one side with a mouth-like cut-out 2*a*, as well as a main nozzle 3, an auxiliary nozzle 4 and a catching passage 5, which are arranged in the carrier 2 and which open into the cut-out 2*a*. The main nozzle 3 in the exemplary embodiment comprises a nozzle tube, which is arranged on the one side of the cut-out 2*a*, and the outlet opening of which is directed towards a catching opening 5*a* of the catching passage 5 which is disposed on the opposite side of the cut-out 2*a*, with the distance between the outlet opening of the main nozzle 3 and the catching opening 5*a* advantageously being chosen to be less than the diameter of the catching opening 5*a*. The protruding part of the nozzle tube serves in the exemplary embodiment as an upper guide 6*a* in order to guide an inserted weft thread 9 to the catching opening 5*a*. The mouth-like cut-out 2*a* comprises a protruding part, the oblique inner surface of which serves as a lower guide 6*b* for the weft thread 9. The catching opening 5*a* is arranged directly at the end of the guides 6*a* and 6*b* so that an inserted weft thread 9, which slides along the guides in the cut-out 2*a*, is guided to the catching opening 5*a*. In the exemplary embodiment the auxiliary nozzle 4 opens into the cut-out 2*a* directly before the main nozzle 3, with the jet directions of the main and of the auxiliary nozzle extending parallel so that a weft thread 9 which is located in the active region 4*a* of the auxiliary nozzle 4 is transported by an air jet of the auxiliary nozzle along the guide 6*a* to the catching opening 5*a* and thus into the active region 3*a* of the main nozzle 3.

In addition to the catching and holding apparatus 1, a reed 8 with reed lamella 8*a* and a guiding passage 8*b* for the weft thread 9 is drawn in in FIG. 1. In a first variant embodiment the reed 8 with the inserted weft thread 9 is located in an initial position after the weft insertion in which the weft thread is not yet seized by an air jet of the main or the auxiliary nozzle. Only through a beat-up movement of the reed 8 is the weft thread 9 transported into a position 9' in the active region 4*a* of the auxiliary nozzle 4. In this the catching and holding apparatus 1 is arranged in such a manner that the inserted weft thread 9 is transported by the beat-up movement of the reed into the cut-out 2*a* and into the active region 4*a* of the auxiliary nozzle 4. The further beat-up movement of the reed 8, the guides 6*a* and 6*b* and the air jet of the auxiliary nozzle 4 then cause the weft thread 9 to be reliably brought into the active region 3*a* of the main nozzle 3. The significance of the guides and the main nozzle 3 becomes understandable if one considers that the position of the inserted weft thread 9 is subject to local scatterings in the guide passage 8*b* and that a certain time is required until the weft thread comes to rest after the insertion. Of course it is also possible to arrange the auxiliary and the main nozzle directly adjacent to the initial position 8*b* of the guide passage.

Very many variant embodiments are possible in the shaping of the cut-out 2*a* and the arrangement of the nozzles and guides. Thus for example the jet direction of the auxiliary nozzle 4 can also be arranged at an acute angle to the main nozzle 3. What is important is that the air flow of the auxiliary nozzle 4 assists the movement of the weft thread 9 along the guide or guides and contributes to bringing the weft thread reliably into the active region 3*a* of the main nozzle 3 and that the air flow of the auxiliary nozzle 4 does not impair the functioning of the main nozzle 3. Depending on the application it can be advantageous to arrange the auxiliary nozzle 4 to be displaced laterally, i.e. in the longitudinal direction of the weft thread, from the main nozzle 3. As guides, for example, correspondingly shaped surfaces of the carrier 2, protruding nozzle tubes or additional guide elements can be used.

Figure 2A:
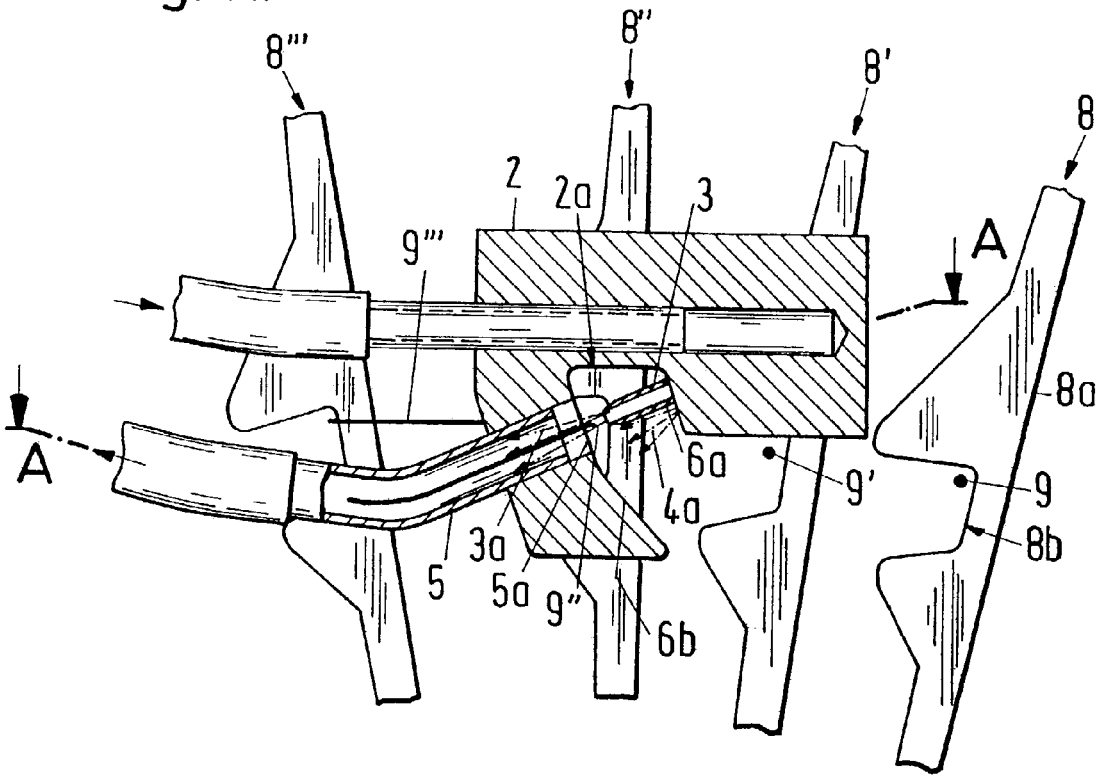
FIG. 2*a* is the cross-section of FIG. 1 with an illustration of the reed in different positions during the beat-up movement.
Figure 2B:
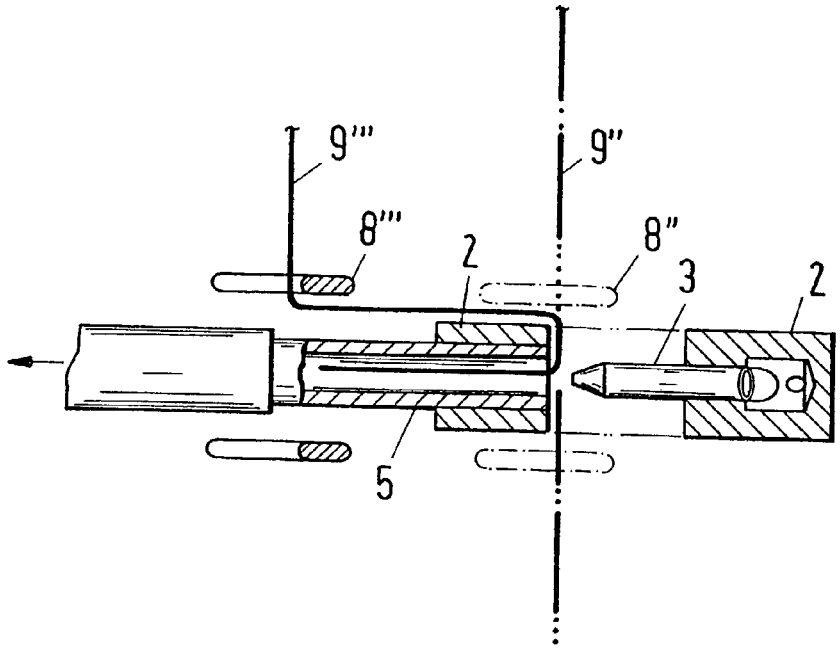
FIG. 2*b* is an oblique section A—A pertaining to FIG. 2*a* along the axes of the main nozzle and of the catching passage.

FIG. 2*a* shows a cross-section through the catching and holding apparatus of the first exemplary embodiment which is similar to that of FIG. 1, with the reed being additionally illustrated in different positions during the beat-up movement; and FIG. 2*b* shows an oblique section along the axes of the main nozzle and of the catching passage through the catching and holding apparatus which is illustrated in FIG. 2*a*. To the far right in FIG. 2*a* the reed 8 with the reed lamellae 8*a* and the guiding passage 8*b* for the weft thread 9 is shown in the initial position, i.e. immediately after the weft insertion. The reference symbol 8' designates an intermediate position of the reed and the reference symbol 8" designates the position of the reed during the blowing in of the weft thread 9" into the catching passage 5. The beat-up position 8" of the reed is illustrated on the left side, with the captured weft thread 9" being shaped through the adjacent reed lamella to a U-shaped loop. In this the free end of the weft thread 9" is held and stretched by the compressed air which flows from the main nozzle 3 through the catching passage 5.

Figure 3:
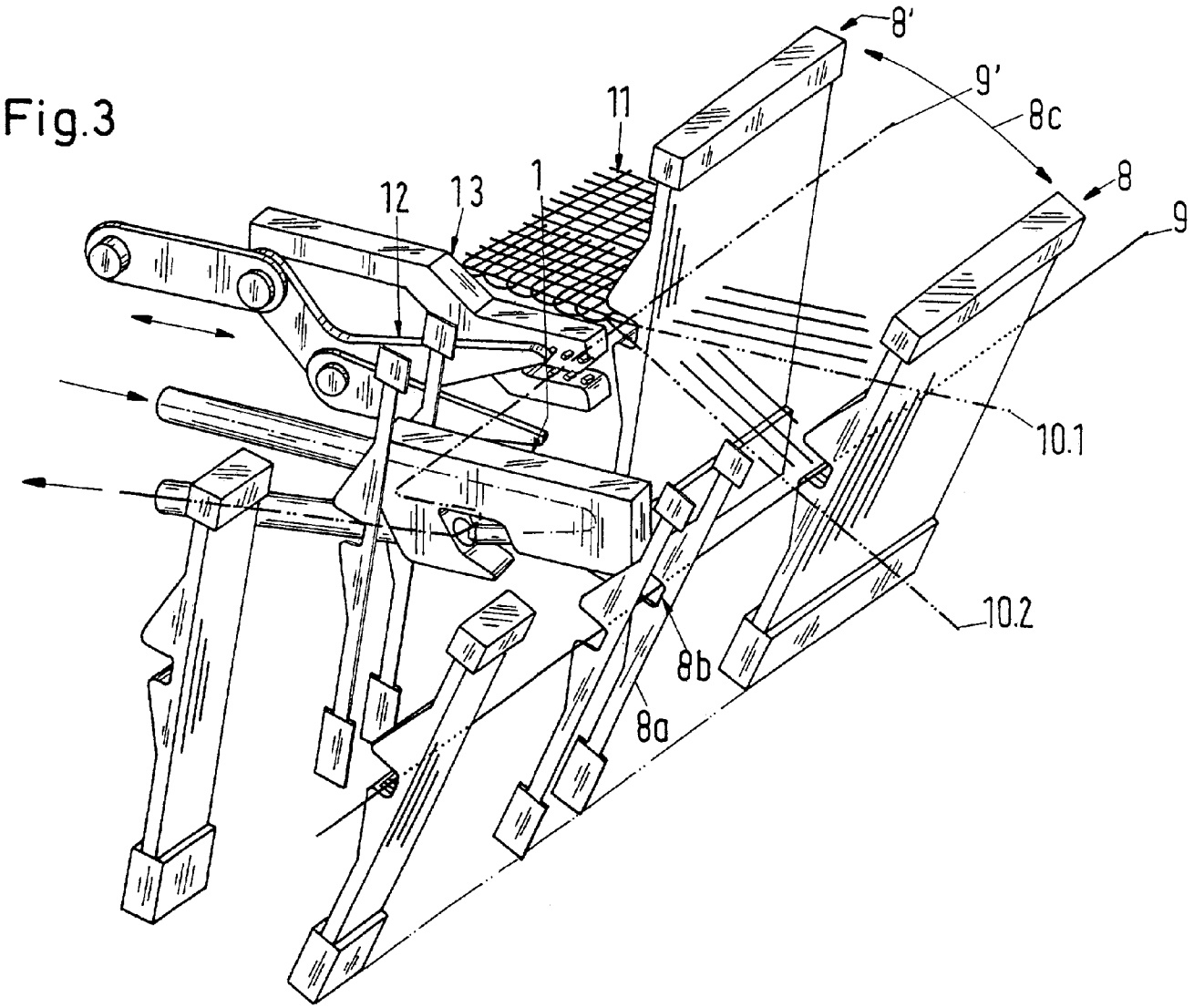
FIG. 3 is a perspective view of the first exemplary embodiment in the installed state.

FIG. 3 shows a perspective view of the first exemplary embodiment, installed in an air jet weaving machine. The catching and holding apparatus 1 is arranged stationarily at the catching-side end of a weft thread 9 or 9' respectively. A reed with reed lamella 8*a* is illustrated once in the initial position 8, i.e. immediately after the weft insertion, and once in the beat-up position 8', in which the weft thread 9' is beat up at a cloth 11. The cloth 11 is formed out of the weft threads 9' and warp threads 10.1 and 10.2 which extend at right angles to the weft threads. Arranged between the catching and holding apparatus 1 and the cloth 11 are a shear 12 for severing the weft threads 9' and a so-called air inserter 13 for inserting the severed weft thread.

Figure 4A:
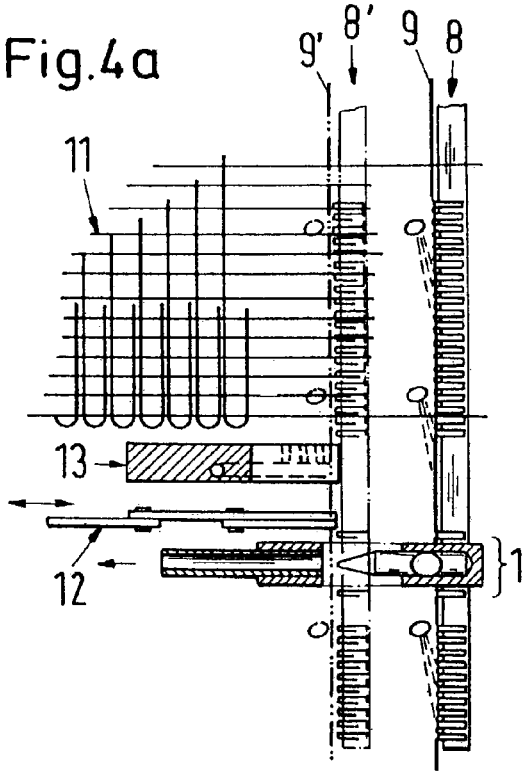
FIG. 4*a* is a view of the first exemplary embodiment in the installed state from above, with the reed in its initial position and in a middle position.
Figure 4B:
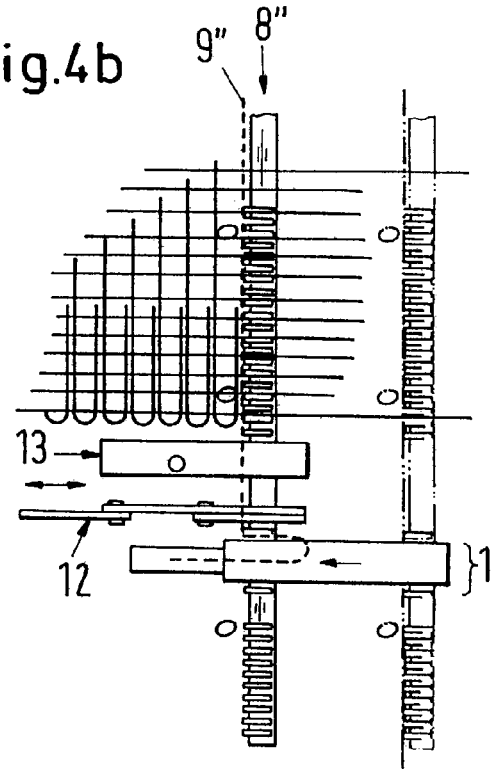
FIG. 4*b* is the view of the first exemplary embodiment which is illustrated in FIG. 4*a*, with the reed in the beat-up position.
Figure 4C:
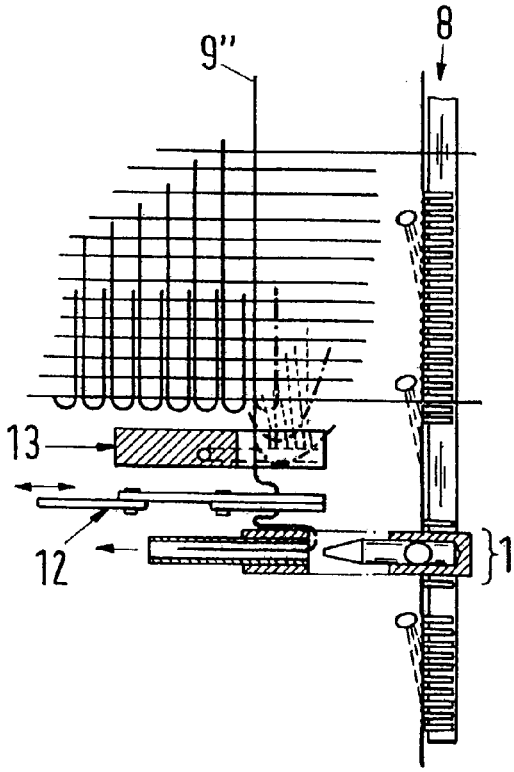
FIG. 4*c* is the view of the first exemplary embodiment which is illustrated in FIG. 4*a*, with the reed in its initial position and with a severed weft thread.

FIGS. 4*a* through *c* show from above the catching and holding apparatus of FIG. 3, which is installed in an air jet weaving machine. In FIG. 4*a* the reed is illustrated with the weft thread 9 in the initial position 8 and in a middle position 8' in which the weft thread 9' is blown into the catching passage by the main nozzle of the catching and holding apparatus 1. FIG. 4*b* shows the reed in the beat-up position 8", and FIG. 4*c* shows how the beat-up weft thread 9" is severed by means of the shear 12 and inserted by means of the air inserter 13.

Figure 5:
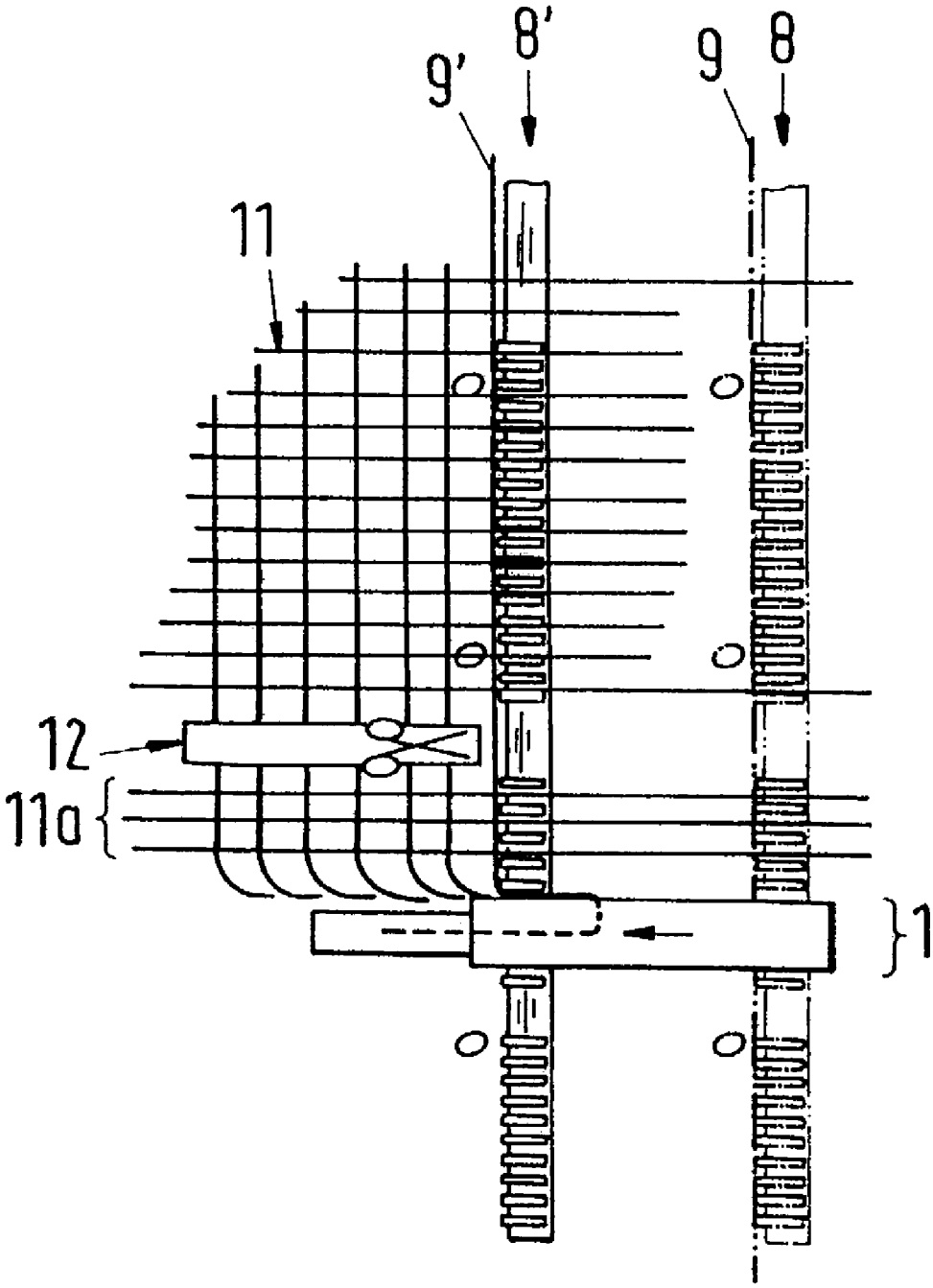
FIG. 5 is a view of an installation variant pertaining to the first exemplary embodiment with an auxiliary selvedge.

FIG. 5 shows a variant of the exemplary embodiment which is illustrated in FIGS. 4*a* through *c*. In this variant a selvedge inserter for the severed weft threads is dispensed with. For this purpose the cloth 11 is provided with a so-called auxiliary selvedge 11*a*, which is severed by means of a shear 12.

Figure 6A:
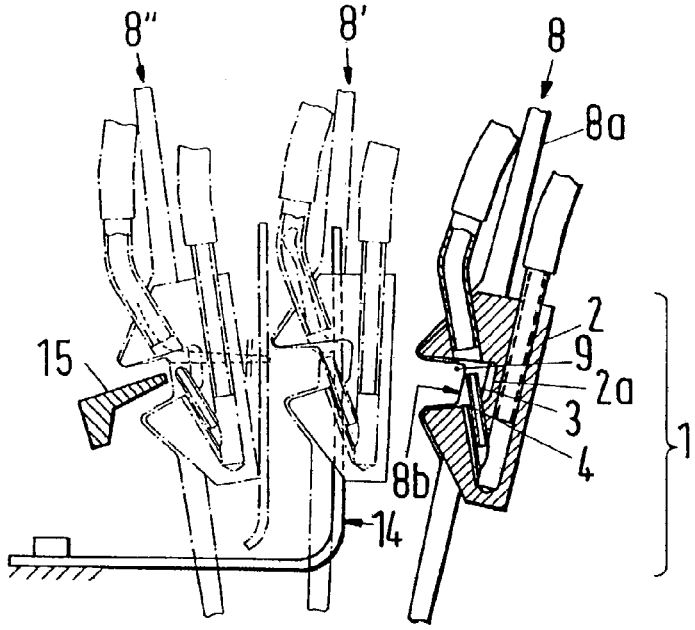
FIG. 6*a* is a second exemplary embodiment pertaining to the present invention in cross-section with an illustration of the reed in different positions during the beat-up movement.
Figure 6B:
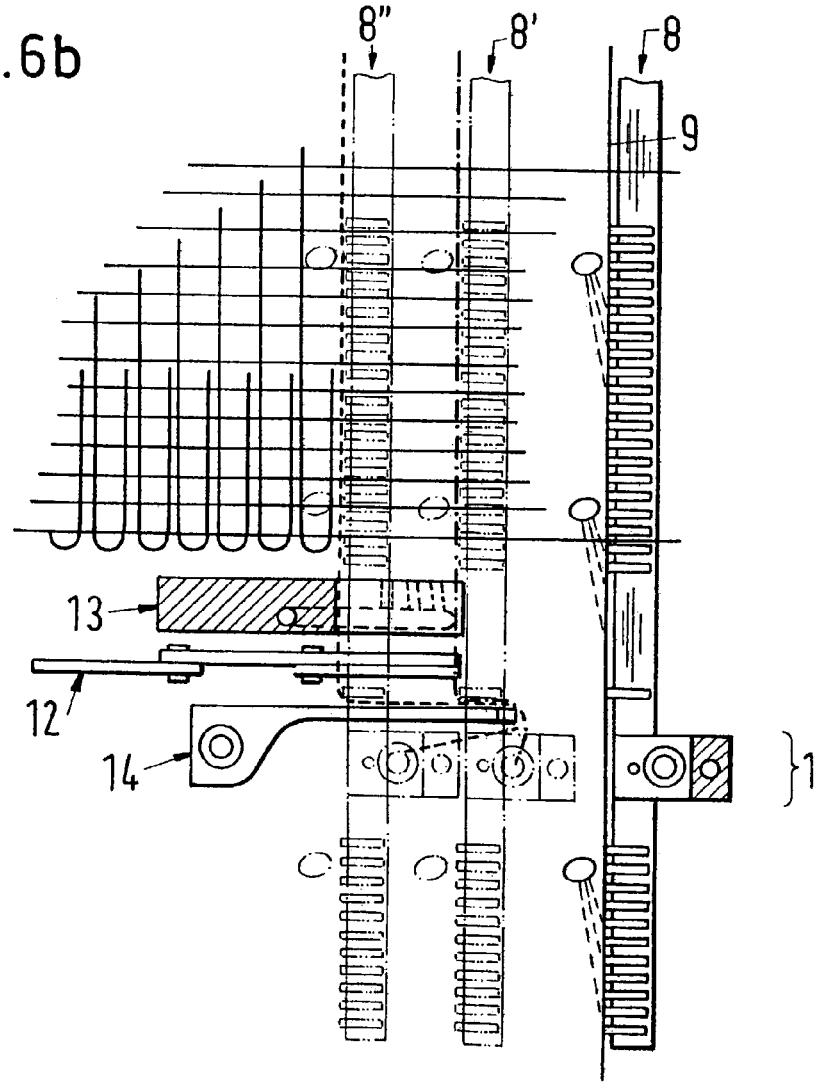
FIG. 6*b* is a view from above pertaining to the exemplary embodiment of FIG. 6*a*.

The method in accordance with the invention for the catching, stretching and holding of a catching-side weft thread end in a weaving machine will be explained in more detail with reference to FIGS. 2*a*, 2*b* and 3. The weaving machine is equipped with a catching and holding apparatus 1 comprising a main nozzle 3 and a catching passage 5 and with a reed 8. In addition the catching and holding apparatus 1 comprises an auxiliary nozzle 4, one or more guides 6*a* and 6*b* and in some cases an additional deflector element 14 (FIGS. 6*a*, 6*b*). After the weft insertion the catching-side end of the inserted weft thread 9 is transported by a beat-up movement of the reed 8 into the active region 4*a* of the auxiliary nozzle 4, where the weft thread end is engaged by an air jet of the auxiliary nozzle 4 and is brought along the one or more guides 6*a* and 6*b* into the active region 3*a* of the main nozzle 3. There the weft thread end is engaged by an air jet of the main nozzle 3 and is blown into the catching passage 5, with the weft thread end being stretched and held.

In an advantageous variant embodiment of the above method, the weaving machine additionally comprises a severing apparatus 12; the weft thread end which is held and stretched by means of the catching and holding apparatus 1 is severed by means of the severing apparatus 12; and the severed weft thread end is transported away through the catching passage 5 by the air flow of the main nozzle 3, for example in that the weft thread end is blown into a collection receptacle through a hose which is connected up to the catching passage 5. The described method for transporting away the severed weft thread ends is economical and can in principle be used for practically all kinds of catching, stretching and holding nozzles.

A second exemplary embodiment will be explained in more detail with reference to FIGS. 6*a* and 6*b*. FIG. 6*a* shows a cross-section through a catching and holding apparatus 1 which is mounted on a weaving machine. The catching and holding apparatus 1 comprises a carrier 2 which is mounted on a reed 8 and/or on a sley which is in contact with the reed 8. The carrier 2 of the catching and holding apparatus 1 is thus co-moved with the reed 8 in a beat-up movement. Furthermore, the catching and holding apparatus 1 comprises a deflector element 14 which is mounted stationarily on the weaving machine. The reed 8 comprises reed lamella 8*a* which are equipped with a guiding passage 8*b* for a weft thread 9. The carrier 2 is provided with a cut-out 2*a* which is designed and arranged in such a manner that it surrounds the guiding passage 8*b* on three sides and is open on the same side as the guide passage, with the free passage of the weft thread through the guiding passage during the weft insertion and the unhindered dipping in of a cloth support during the weft insertion remaining ensured. Furthermore, the catching and holding apparatus 1 comprises a main nozzle 3, a catching passage 5 and an auxiliary nozzle 4, which are arranged in the carrier 2 as described in the first exemplary embodiment. The main nozzle 3 comprises a nozzle tube, the protruding part of which serves as a guide for the weft thread 9 and is arranged directly outside the inner boundary of the guiding passage 8*b*. The auxiliary nozzle 4 opens into the cut-out 2*a* directly in front of the nozzle tube of the main nozzle 3, with the jet directions of the main and the auxiliary nozzle being parallel, so that a weft thread 9 which is located in the active region 4*a* of the auxiliary nozzle 4 is brought into the active region 3*a* of the main nozzle 3 by an air jet of the auxiliary nozzle along the nozzle tube, which serves as a guide.

The reed 8 is illustrated in three different positions in FIG. 6*a*. At the right in FIG. 6*a* the reed is in the initial position 8 corresponding to the position immediately after the weft insertion. In the middle position 8' the inner boundary of the guide passage has just passed the deflector element 14; i.e. the weft thread end was drawn by the deflector element towards the inner boundary of the guide passage and thus into the active region 4*a* of the auxiliary nozzle 4, was brought by an air jet of the auxiliary nozzle along the nozzle tube which acts as a guide into the active region 3*a* of the main nozzle 3 and was then blown into the guiding passage by an air jet of the main nozzle. At the left in FIG. 6*a* the reed is in the beat-up position 8". Furthermore, the profile of a cloth support 15, which protrudes into the guiding passage in the beat-up position, is illustrated on the left side. FIG. 6*b* shows the second exemplary embodiment in a view from above.

Figure 7A:
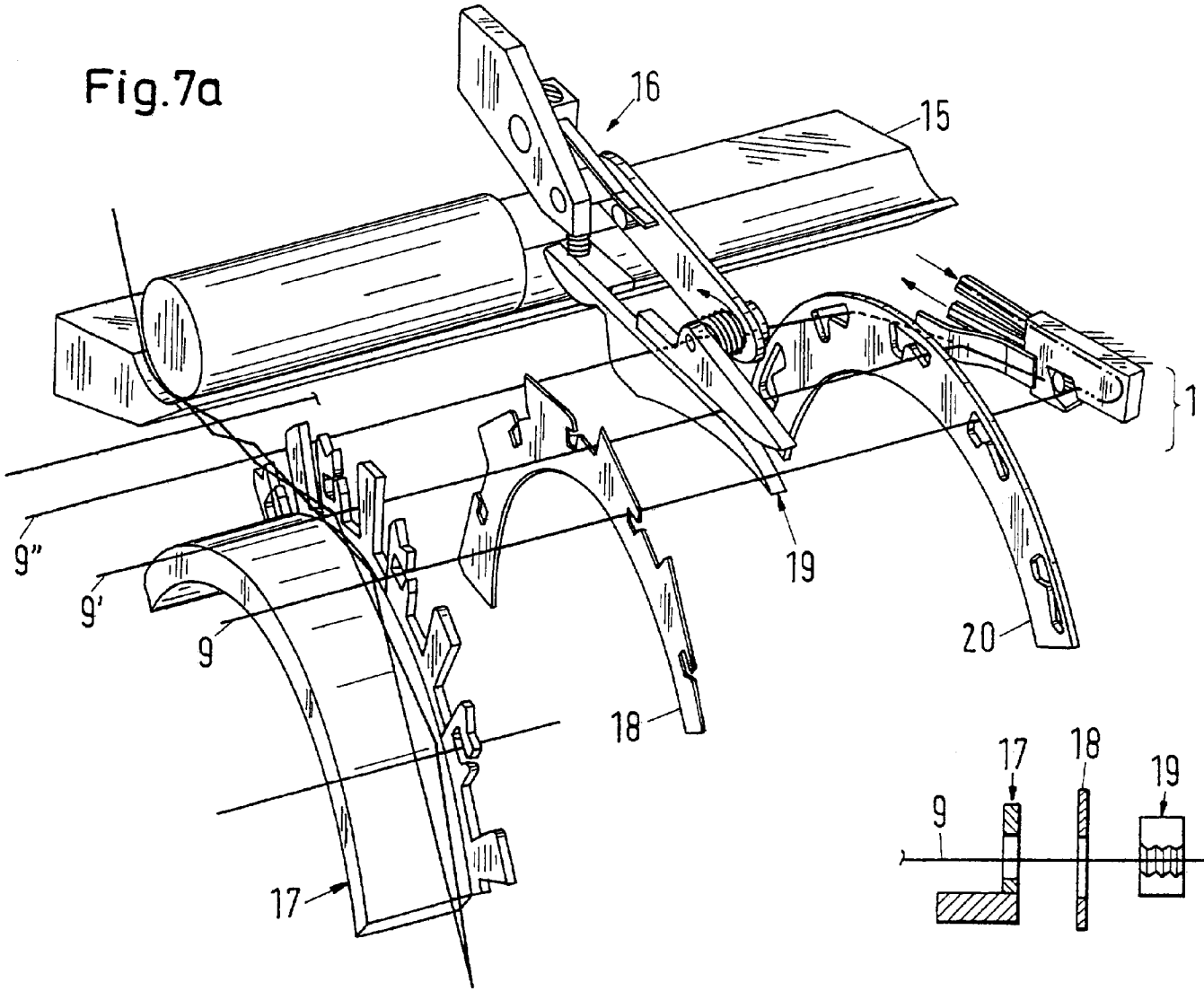
FIG. 7*a* is a perspective view of an apparatus in accordance with the invention which is installed in a series shed weaving machine.
Figure 7B:
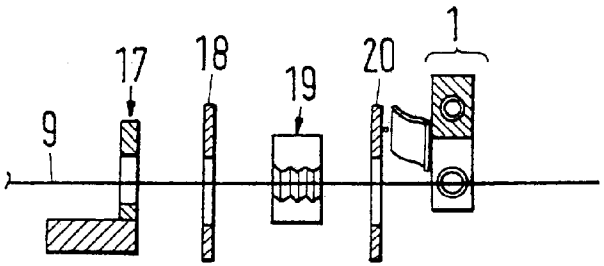
FIG. 7*b* is a longitudinal section along a weft thread through the series shed weaving machine which is illustrated in FIG. 7*a*.

FIGS. 7*a* and 7*b* show the catching and holding apparatus in accordance with the invention in the installed state in a series shed weaving machine. FIG. 7*a* is an oblique view of the catching, holding and forwarding elements for catching, holding and forwarding the catching-side weft thread ends, and FIG. 7*b* is a longitudinal section through the named elements along a weft thread 9. Arranged at the catching-side weft thread ends are, one after the other, a weaving rotor 17 with shed forming elements, a first forwarding element 18 with open weft thread co-moving openings, a holding apparatus 16 with clamping jaws 19, a second forwarding element 20 with closed weft thread co-moving openings and a catching and holding apparatus 1 in accordance with the invention. The forwarding elements 18 and 20 are connected to the weaving rotor 1, whereas the holding apparatus 16 and the catching and holding apparatus 1 are mounted stationarily on the weaving machine. A possible embodiment of the catching and holding apparatus 1 was described in more detail in the framework of the first exemplary embodiment. The method of functioning of the catching and holding apparatus in FIG. 7*a* also corresponds substantially to the method of functioning that was described in the framework of the first exemplary embodiment. The principal difference consists in that the inserted weft thread is transported by a reed into the active region of the auxiliary nozzle in the exemplary embodiment which is illustrated in FIGS. 1 through 5, whereas the forwarding elements 18 and 20 transport the weft thread into the active region of the auxiliary nozzle in the series shed weaving machine which is shown in FIG. 7*a*.

The advantageous use of the catching and holding apparatus in accordance with the invention and of the method in accordance with the invention is not restricted to the mentioned air jet and the mentioned series shed weaving machine. When a compressed air connection is present, the catching and holding apparatus in accordance with the invention and the method in accordance with the invention can be used in practically all weaving machines with suitable adaptations.

The invention claimed is:

1. A catching and holding apparatus for catching and holding a catching side end of a weft thread inserted in a weft of a weaving machine, said catching and holding apparatus comprising a main nozzle with a local active region and a catching passage with a catching opening at the entry, wherein the catching opening lies in the active region of the main nozzle with an outlet opening of the main nozzle being located in front of the catching opening for deflecting the weft thread end into the catching passage, wherein the catching and holding apparatus comprises a carrier on which the main nozzle and the catching passage are arranged, wherein the catching and holding apparatus also comprises an auxiliary nozzle with a local action region and one or more guides, said auxiliary nozzle and guides being arranged on the carrier in such a manner that a weft thread end which is located in the active region of the auxiliary nozzle is brought by an air jet of the auxiliary nozzle along the guides into the active region of the main nozzle.

2. A catching and holding apparatus in accordance with claim 1, with the catching and holding apparatus being arranged on a weaving machine with a sley and a reed, and with the catching and holding apparatus being arranged in such a manner that the weft thread end can be transported by a beat-up movement of the reed into the active region of the auxiliary nozzle.

3. A catching and holding apparatus in accordance with claim 1, with the carrier comprising a slot or a cut-out, and with the main nozzle comprising a nozzle jet outlet opening which opens into the slot or the cut-out and with the associated catching passage comprising a catching opening which opens into the slot or the cut-out.

4. A catching and holding apparatus in accordance with claim 1, with the jet directions of the main and auxiliary nozzles being arranged to be parallel or to have an acute angle with respect to one another or with the projections of the jet directions onto a plane forming an acute angle.

5. A catching and holding apparatus in accordance with claim 1, with the main nozzle comprising a nozzle tube, and with the forward part of the nozzle tube being usable as a guide along which the weft thread end is transported into the active region of the main nozzle.

6. A catching and holding apparatus in accordance with claim 1, with the nozzle jet outlet opening of the main nozzle being arranged ahead of the catching opening of the catching passage, and with the distance between the nozzle jet outlet opening of the main nozzle and the catching opening of the catching passage not being greater than the diameter of the catching passage.

7. A catching and holding apparatus in accordance with claim 1, with the carrier with the main nozzle, the catching passage, the auxiliary nozzle and the guides being secured on the sley or on the reed, and with the catching and holding apparatus comprising in addition a deflector element which is stationarily mounted on the weaving machine and which is arranged in such a manner that the weft thread end can be transported by means of the deflector element into the active region of the auxiliary nozzle in response to a beat-up movement of the reed.

8. A method for the catching, stretching and holding of a catching-side weft thread end in a weaving machine, said weaving machine comprising a catching and holding apparatus with a main nozzle and a catching passage as well as a reed, wherein the catching and holding apparatus additionally comprises an auxiliary nozzle and one or more guides; and in that the weft thread end is transported into an active region of the auxiliary nozzle by a beat-up movement of the reed, the weft thread end is brought by an airjet of the auxiliary nozzle along the guides into an active region of the main nozzle; and wherein the weft thread end is blown by an air jet of the main nozzle into the entry of the catching passage, with the weft thread end being stretched and held.

9. A method in accordance with claim 8, with the weaving machine additionally comprising a severing apparatus, and with the weft thread end being severed by means of the severing apparatus after its capture by the catching and holding apparatus, and with the severed weft thread end being transported away through the catching passage by the airjet of the main nozzle.

* * * * *

UNITED STATES PATENT AND TRADEMARK OFFICE

CERTIFICATE OF CORRECTION

PATENT NO. : 7,066,213 B2
APPLICATION NO. : 10/421001
DATED : June 27, 2006
INVENTOR(S) : Urs Schaich It is certified that error appears in the above-identified patent and that said Letters Patent is hereby corrected as shown below:

On The Title Page

Please correct the Assignee's Name and Address, section (73), *Assignees*, as indicated below:

Sultex AG, Rueti, SWITZERLAND

Signed and Sealed this

Twenty-eighth Day of November, 2006

JON W. DUDAS

*Director of the United States Patent and Trademark Office*